US005538191A

United States Patent [19]

Holl

[11] Patent Number: 5,538,191

[45] Date of Patent: Jul. 23, 1996

[54] METHODS AND APPARATUS FOR HIGH-SHEAR MATERIAL TREATMENT

[76] Inventor: Richard A. Holl, 2183 Eastridge Trail, Oxnard, Calif. 93030

[21] Appl. No.: 387,769

[22] PCT Filed: Aug. 24, 1993

[86] PCT No.: PCT/US93/07931

§ 371 Date: Feb. 21, 1995

§ 102(e) Date: Feb. 21, 1995

[87] PCT Pub. No.: WO94/04275

PCT Pub. Date: Mar. 3, 1994

Related U.S. Application Data

[63] Continuation-in-part of Ser. No. 935,277, Aug. 26, 1992, Pat. No. 5,279,463.

[51] Int. Cl.[6] ..... B02C 19/18

[52] U.S. Cl. ..... 241/1; 241/17; 241/21; 241/29; 241/228; 241/237; 241/253; 241/261.1; 241/261.2; 241/301

[58] Field of Search ..... 241/1, 301, 17, 241/21, 29, 250, 253, 257.1, 261.1, 261.2, 228, 237

[56] References Cited

U.S. PATENT DOCUMENTS 591,494 10/1897 Pond ..... 241/237
4,784,218 11/1988 Holl ..... 138/38 X
5,279,463 1/1994 Holl ..... 241/1

FOREIGN PATENT DOCUMENTS 220906 4/1985 Germany ..... 214/1
891152 3/1962 United Kingdom ..... 241/1

*Primary Examiner*—Frances Han

[57] ABSTRACT

High-shear treated materials are passed through a high-shear treatment zone which allows the coexistence of free supra-Kolmogoroff eddies larger than the smallest possible Kolmogoroff eddy diameter and forced sub-Kolmogoroff eddies smaller than this diameter. This zone includes a subsidiary higher-shear zone for suppressing these free eddies. The passage walls (40, 44, 102, 108) move relative to one another transverse to the flow to force the simultaneous development of supra-Kolmogoroff and sub-Kolmogoroff eddies while maintaining liquid films adherent to the passage surfaces. The movement produces only forced sub-Kolmogoroff eddies in the subsidiary zone while maintaining a non-turbulent flow. Ultrasonic oscillations (52) may be applied to cause elastohydrodynamic pressure and viscosity increases and/or production of smaller sub-Kolmogoroff eddies. One apparatus includes an inner cylinder rotatable (46) inside a hollow outer cylinder (38), another consists of tow circular coaxial plates, and the rotational axis can be vertical or horizontal.

28 Claims, 8 Drawing Sheets

METHODS AND APPARATUS FOR HIGH-SHEAR MATERIAL TREATMENT

CROSS-REFERENCE TO A RELATED APPLICATION

Insofar as this application constitutes an application in the U.S.A. it is a continuation-in-part of my earlier application Ser. No. 07/935,277 filed 26 Aug. 1992 (26.08.92), now U.S. Pat. No. 5,379,463, for which the benefit of 35U.S.C.120 is also claimed.

TECHNICAL FIELD

The invention is concerned with methods and apparatus for high-shear treatment of flowable materials, the term high-shear treatment as used herein including both mixing and milling, the term mixing in turn including dissolving, suspending and dispersing, and the term milling in turn including grinding, comminuting and deagglomerating. The flowable materials employed each comprise at least two components, one of which is a liquid. The invention is concerned more especially, but not exclusively, with such methods and apparatus in which the flowable materials comprise slurry suspensions of finely divided ceramic materials.

BACKGROUND ART

Increasingly a number of manufacturing processes require the use of finely divided starting materials of, for example, particle size less than 5 microns, frequently of particle size less than 1 micron, and increasingly of particle size as small as 0.1 micron. This is particularly the case with processes for ceramics, where the use of such finely-divided raw materials makes it possible to produce articles having improved properties, such as improved strength, mechanical and thermal shock resistance, and of maximum or near maximum theoretical density after firing or sintering. The particle size distribution is also an increasingly important criterion, and particularly the requirement that all of the particles are of a size within a narrow range about the nominal value. In industrial practice the achievement of such uniformity of particle size is extremely difficult and considerably increases the cost of production.

For example, the manufacture of a ceramic part may require that the starting material be of average particle size 0.3 micron and maximum particle size 1.0 micron, such a small maximum size being necessary to permit, for example, the part to be superplastically forged. It is expected that the particle size distribution will have the typical bell-shape characteristic, with the majority of the material (e.g. about 70% by weight) of about the average size, while small portions (e.g. about 15% each) are oversize and undersize. Even though the material was milled to be of that average size, it is unlikely that as received by its ultimate user it is still in the same state of relatively uniform fine division, since with all particles, and particularly with such fine particles, agglomeration begins immediately the powder leaves the grinding mill, and continues during subsequent handling. Frequently the powders are pelletized to facilitate their transport and handling, and must subsequently be de-pelletized by grinding. The result is that the material is now nonuniform with at least a portion outside the specified range, and there is a high probability it includes a large number of big particles whose presence causes defects in the resultant sintered products. It is also important that the processing of the material, particularly the grinding, does not introduce any appreciable amount of contaminating particles, e.g. less than 0.1% by weight, and preferably less than 0.01% by weight.

Stone (carborundum) and colloid mills are known for use in paint pigment grinding and milling and consist essentially of two accurately shaped smooth stones working against each other, one of which is held stationary while the other is rotated at high speed (3600 to 5400 rpm) with a gap that is regarded by this industry as very small separating the two relatively movable surfaces. Thus, typically the spacing between the two faces is adjustable from positive contact to an appropriate distance, which with such mills is usually from a minimum of 25 micrometers to as much as 3,000 micrometers, but is usually of the order of 50–75 micrometers. In the typical stone mill a charge which is already mixed is fed through a truncated conical gap to the milling region, which has the shape of a flat annular ring, while in a colloid mill, which also requires an already mixed charge, the milling region has the shape of a truncated cone. The grinding of the pigment in its liquid vehicle is produced by the high shear rate smearing action that takes place between the parallel faces of the stones as the material is fed into the gap by gravity, or under pressure. A separation gap of 75 micrometers is said to produce a particle grind having an average particle size of 2–3 micrometers, although the particle size distribution is not given, and substantially larger particles are certainly present. Such mills are satisfactory for such purposes where the uniformity, particle size distribution, maximum particle size and the degree of contamination are relatively uncritical.

DISCLOSURE OF INVENTION

It is a principal object of the invention to provide new methods and apparatus for the high-shear treatment of flowable materials comprising at least two components, one of which is a liquid, such high-shear treatment comprising for example uniform mixing, which includes suspension, dispersion, and solution of gases and powdered materials in liquid vehicles, and/or uniform milling, which includes grinding, deagglomeration, and comminution of powdered materials in slurry suspensions thereof.

It is a more specific object to provide such methods and apparatus that are particularly applicable to the uniform milling of finely divided ceramic materials in slurry suspensions thereof.

In accordance with the present invention there is provided new methods for high-shear treatment of flowable materials as defined herein, the methods comprising:

passing the material to be treated in a flow direction in a flow path constituted by a passage between two closely spaced passage surfaces provided by respective mill members, the passage having an inlet thereto and an outlet therefrom;

characterised in that:

the flow path includes an overall high-shear treatment zone in which the spacing between the passage surfaces allows the coexistence of free supra-Kolmogoroff eddies which are larger than the smallest Kolmogoroff eddy diameter for the flowing material and forced sub-Kolmogoroff eddies which are smaller than the smallest Kolmogoroff eddy diameter;

the overall high-shear treatment zone includes at least a portion thereof in which the passage spacing is smaller than in the remainder of the zone to provide a subsidiary higher-shear treatment zone in which free supra- Kolmogoroff eddies are suppressed during passage of the material therethrough; and while the material is moving in the overall high-shear treatment zone the mill members are moved relative to one another to thereby move the mill passage surfaces relative to one another in a direction transverse to the flow direction at a relative speed such as to force the simultaneous development of supra-Kolmogoroff and sub-Kolmogoroff eddies for the treatment of the material therein on a supra-micron and sub-micron scale with maintenance of the respective liquid films adhereing to the relatively moving passage surfaces, so as to thereby render the treated material as uniform as possible;

such relative movement producing in the subsidiary higher-shear treatment zone only forced sub-Kolmogoroff eddies with maintenance of non-turbulent flow.

Also in accordance with the present invention there is provided new apparatus for high-shear treatment of flowable materials employing the methods as defined in the immediately preceding paragraph.

Preferably the subsidiary higher-shear treatment zone includes a gap of minimum spacing between the passage surfaces towards which the passage surfaces spacing decreases for the generation of hydrodynamic pressure in the flowing material and resultant local increase in viscosity in the material for enhancement of the treatment action.

Longitudinal pressure oscillations may be applied to a wall of the passage in the overall high-shear treatment zone for enhancement of the treatment action by producing in the material increases in the local viscosity resulting from an elastohydrodynamic squeeze film effect in the liquid films, and/or from the production of forced sub-Kolmogoroff eddies therein.

The mill members may be respectively a stationary hollow outer cylinder and a rotatable inner cylinder mounted within the stationary hollow outer cylinder for rotation about a respective longitudinal rotational axis, and the two cylinders may also be mounted for movement relative to one another transverse to the rotational axis to thereby vary the spacing between the two opposed flow passage surfaces.

Alternatively the mill members may be circular plates mounted for rotational movement relative to one another about a common rotational axis passing through their centres, the passage surfaces being constituted by respective opposed surfaces of the two plates, the plates also being mounted for movement relative to one another along the rotational axis to vary the distance between the two opposed surfaces.

The rotational axis may be vertical or horizontal.

DESCRIPTION OF THE DRAWINGS

Particular preferred embodiments of the invention will now be described, by way of example, with reference to the accompanying diagrammatic drawings, wherein.

Similar or equivalent parts are given the same reference number in all of the figures of the drawings, wherever that is possible.

The spacings between cooperating surfaces of the mills are considerably exaggerated for clarity of illustration.

MODES FOR CARRYING OUT THE INVENTION

The embodiments of FIGS. 1–5 are characterised herein as "drum" mills, in that the cooperating cylindrical shaped mill surfaces are provided by respective drum shaped members, while the embodiments of FIGS. 6–11 are characterised as "plate" mills, in that the cooperating mill surfaces are provided by respective plate shaped members. Before describing the construction of the mills, and their respective modes of operation, typical systems for the production of ceramic slurries employing the mills will be described.

Figure 12:
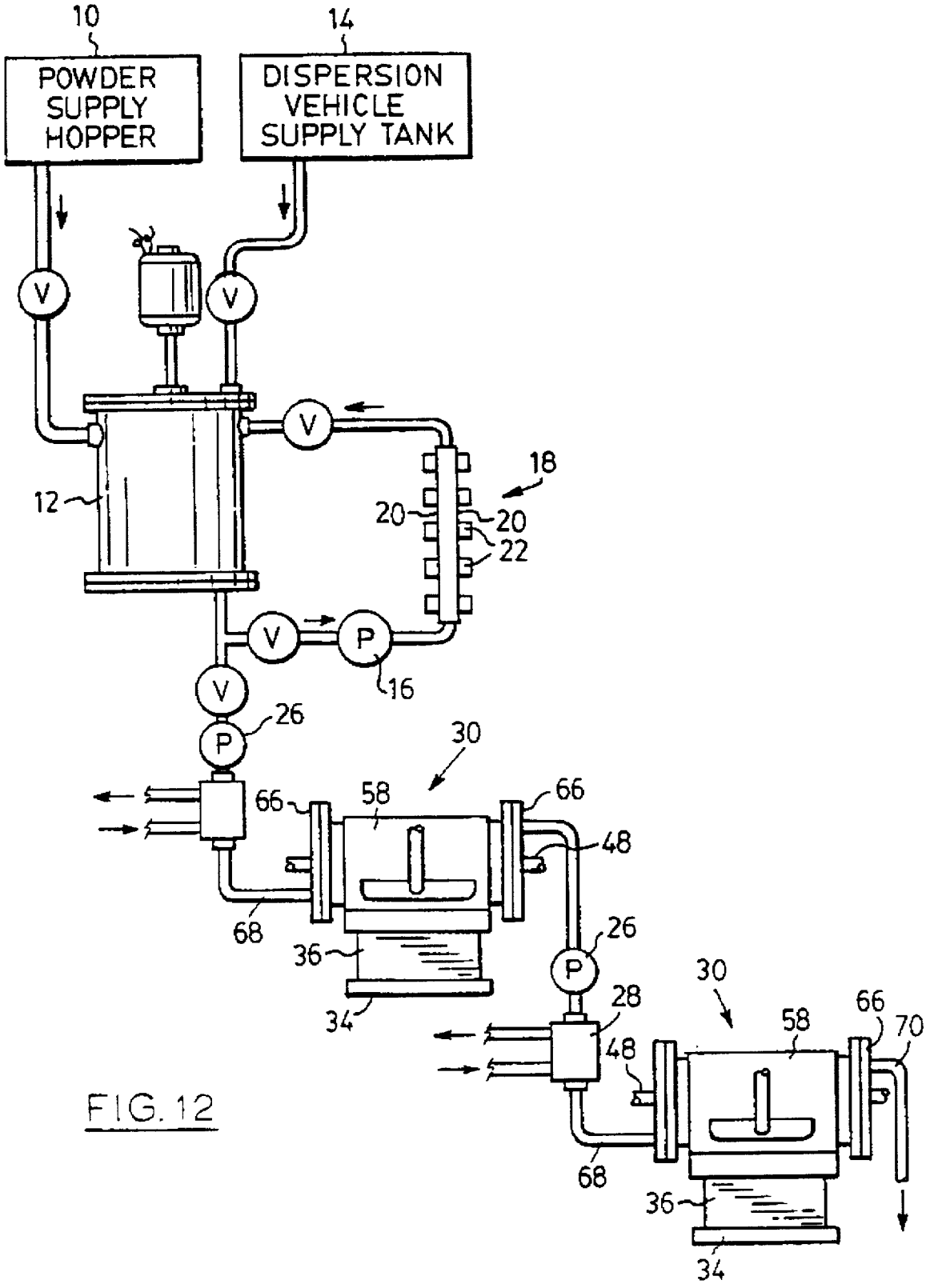
FIG. 12 is a schematic diagram illustrating a continuous flow slurry milling system employing a plurality of drum mills of the invention in series, the system also comprising a single reverbatory ultrasonic mixer in a recirculating premixing circuit that feeds the mills.

In the continuous flow system illustrated by FIG. 12 finely divided powder is to be milled so as to be uniformly dispersed in a liquid vehicle and ground (with any necessary deagglomeration) to a smaller particle size. Powder from a supply hopper 10 is fed to a drum mill 12 while a liquid dispersion vehicle is fed from a supply tank 14, a preliminary rapid coarse dispersion being obtained by circulating the mixture in a closed circuit comprising the reservoir of drum mill 12, a pump 16, and a high flow capacity reverbatory ultrasonic mixer (RUM mixer) 18.

The liquid dispersion vehicle, whether aqueous or non-aqueous, will usually include a dispersing agent or agents and usually will also include other functional additives, such as binders, plasticizers and lubricants. The relative proportions of the powder or powders, the functional additives, and of the dispersion vehicle, are usually made such that the final dispersion is of sufficient liquid content in order to avoid problems associated with dilatency.

Preferably the RUM mixer 18 is of the type disclosed in my U.S. Pat. No. 4,071,225, the disclosure of which is incorporated herein by this reference. Briefly, such a mixer comprises an elongated chamber of thin rectangular transverse cross section having the two parallel wider walls formed by two flat, very closely spaced plates 20, each of which has a plurality of ultrasonic transducers 22 mounted on its exterior so as to direct the pressure oscillations into the chamber and towards the opposite wall, the oscillations from the opposed transducers interfering with one another in reverberation and in a manner which produces intense small eddies that are particularly effective to produce mixing and pre-dispersion of the powder into the medium.

As is well known to those skilled in this art, the thorough dispersion of fine powders into a liquid dispersing vehicle using the conventional high shear mechanical stirring mixers, or ball or sand mills, is a lengthy and tedious process, often requiring several days to obtain an acceptable dispersion. There are a number of reasons for this, such as the increasing surface area to be wetted as the particle size decreases, the inherent difficulty of wetting such fine particles, and the difficulty of deagglomerating the agglomerates that inevitably are present. Other reasons will be discussed below. A RUM mixer such as that disclosed and briefly described above is able to produce acceptable dispersions in periods as short as 5–15 minutes, although with some processes it may be preferred to employ longer mixing periods of perhaps 30–45 minutes. If a completely continuous system is preferred the single RUM mixer can be replaced by a series of such mixers.

Upon completion of this preliminary step the coarsely dispersed slurry is discharged via a pump 26 and a cooler 28 to a series of drum mills 30 of the invention, only two of which are shown. A pump and cooler are provided for each mill to permit control of the rate, pressure and temperature at which the slurry is fed to the respective mill, the cooler compensating for heating of the slurry produced by the preceding mill. A plurality of plate mills or a mixture of drum and plate mills can also be used.

Figure 13:
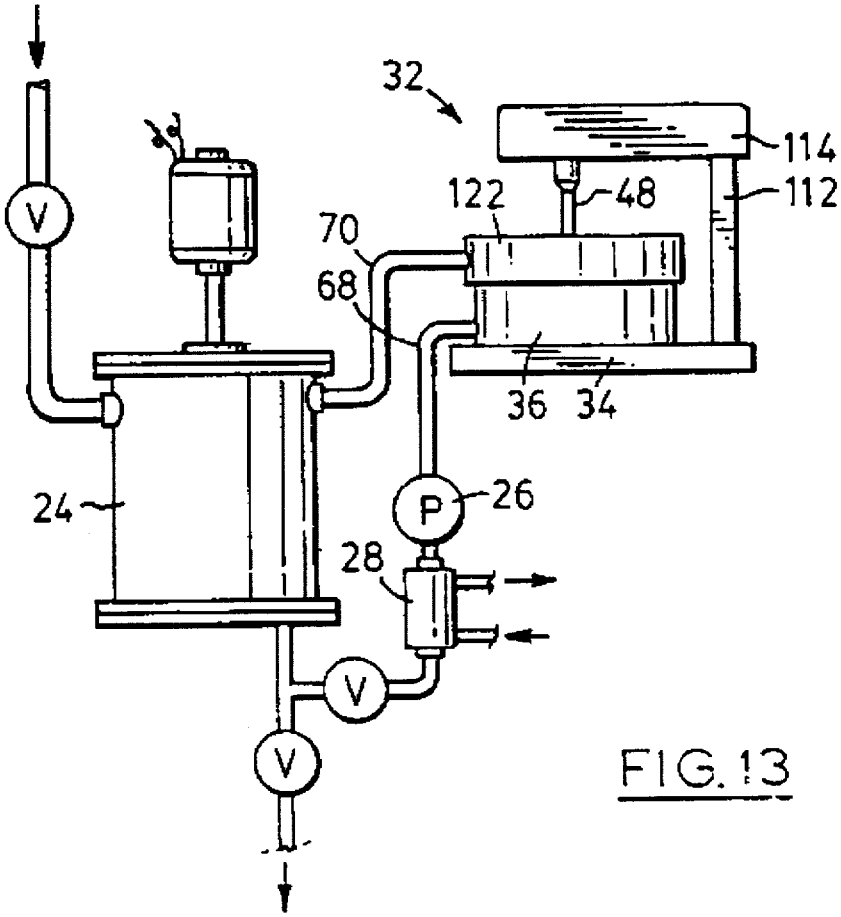
FIG. 13 (sheet 7) is a schematic diagram to illustrate a batch processing system employing a single plate mill through which the slurry is recirculated.

FIG. 13 illustrates the manner in which a single mill, shown herein as a plate mill 32, is used in a recirculating circuit to carry out a batch process. Premixed slurry from a RUM mixer system is fed to a drum mixer 24 and is delivered by the single pump 26 and cooler 28 to the mill inlet. The mill outlet pipe discharges back to the drum mixer 24, and the slurry is recirculated until the desired particle size distribution has been obtained. The process will usually be operated with a predetermined protocol whereby the mill initially treats the slurry for a maximum operative particle size, and is adjusted as the process proceeds, either progressively or stepwise, until it is producing particles of the required minimum size. A single drum mill can instead be used.

Figure 1:
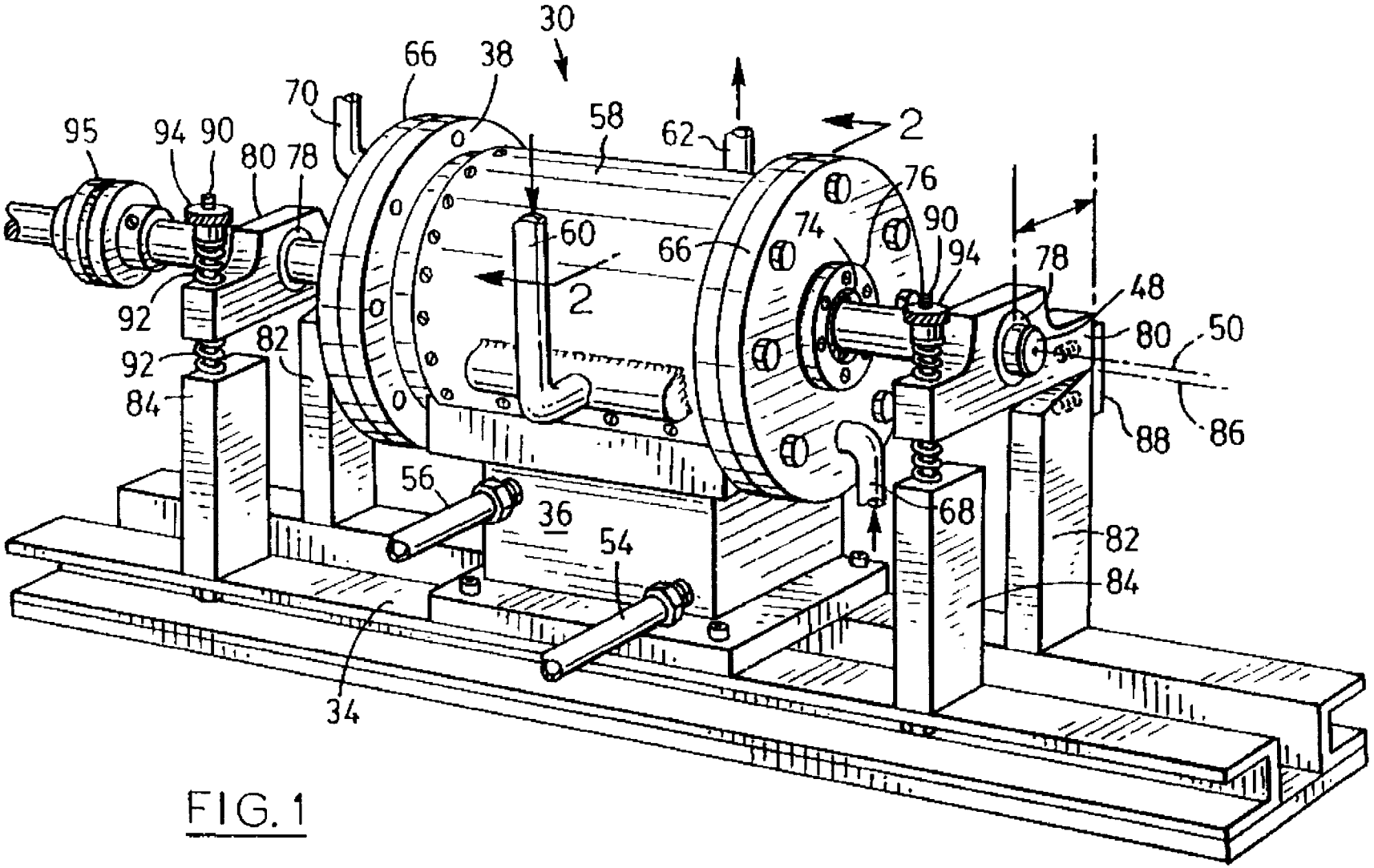
FIG. 1 is a perspective view from one side of a drum mill which is a first embodiment of the invention, and in which the mill members rotate relative to one another about a horizontal axis.
Figure 2:
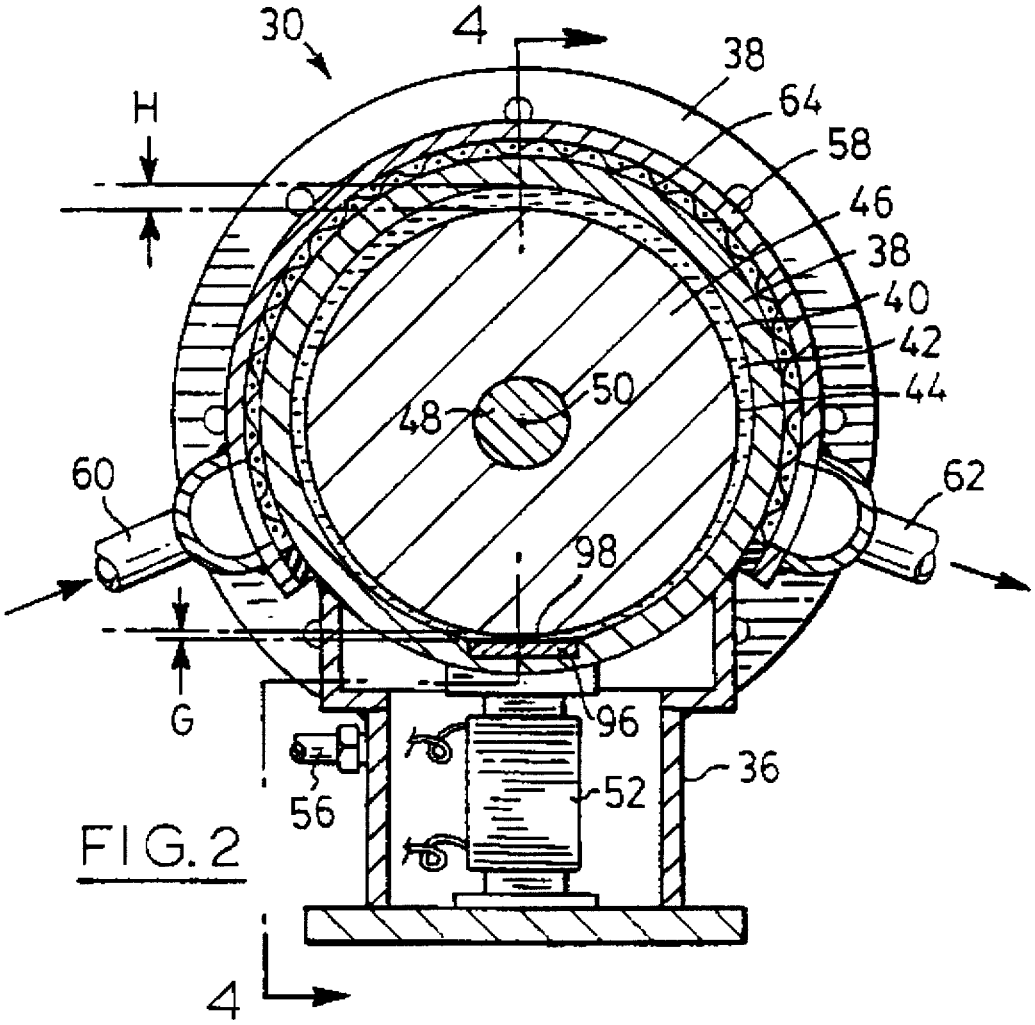
FIG. 2 is a transverse cross section through the body of the drum mill of FIG. 1, taken on the line 2—2 therein.
Figure 3:
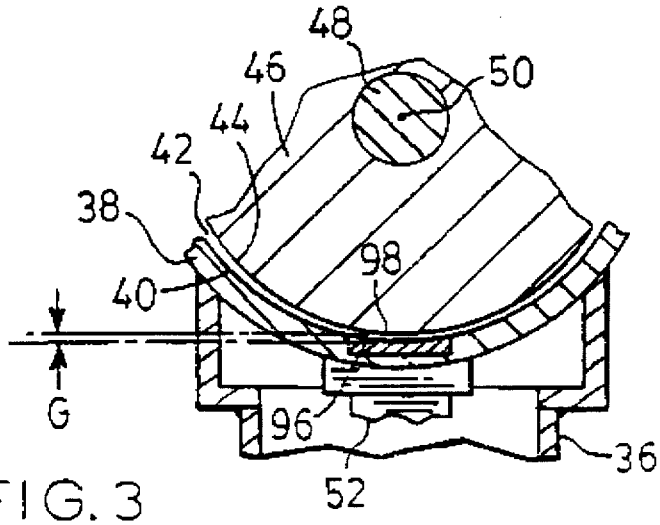
FIG. 3 is a partial transverse cross-section, taken on the same line as in FIG. 2, illustrating another embodiment.

Referring now to FIGS. 1–3 a drum mill comprises an apparatus base frame 34 on which is mounted by means of an intermediate casing 36 a stationary outer hollow cylindrical mill member 38, inner cylindrical surface 40 of which constitutes one operative wall of an annular passage 42 forming a flow path for the material to be treated. The other operative wall of the passage is constituted by outer cylindrical surface 44 of an inner cylindrical mill member 46, which in this embodiment is a solid cylinder mounted on a shaft 48 for rotation within the hollow cylinder about a horizontal axis 50. Transducers 52 (FIG. 2) are mounted within the casing 36 and connected to the outer cylinder 38 so as to direct the longitudinal pressure oscillations that they generate into the adjacent portion of the passage 42, and also to vibrate at least the adjacent portion of the cylindrical wall to cyclically vary the passage thickness, at least this portion of the passage constituting an overall high-shear treatment zone, as will be discussed below. The transducers are connected to a power source (not shown) for synchronous, in-phase operation and are supplied with cooling fluid via an inlet 54 and an outlet 56. As much as possible of the remainder of the exterior of member 38 is enclosed by a cover plate 58 forming a part annular enclosure for the passage of cooling water that enters through an inlet 60 and leaves through an outlet 62. The space between the cover plate and the member exterior is filled with wire mesh 64 to increase the cooling efficiency of the enclosure.

The interior of the cylindrical member 38 is closed by two circular cover plates 66 attached to respective end flanges, one of the cover plates mounting a slurry inlet pipe 68 at its lowermost point, while the other mounts a slurry outlet pipe 70 at its uppermost point. The two plates are provided with aligned enlarged holes 72 through which the shaft 48 passes while permitting movement of the shaft and the inner mill member relative to the stationary outer member for adjustment of the size of an axially extending linear gap G (FIG. 2) in the treatment zone. An annular gasket seal 74 at each end is sandwiched between respective cover plate 66 and a retaining washer 76 to prevent escape of material.

The shaft 48 is mounted for rotation by two bearings 78, each of which is carried by a respective crossbar 80 that is in turn mounted on the top ends of two transversely spaced vertically extending rectangular cross section posts 82 and 84. The top surface of each post 82 is inclined inward and downward to the horizontal, so that the post outer edge constitutes a knife edge pivot for the crossbar about an axis 86 parallel to the shaft axis 50. This end of the crossbar is attached to the respective post 82 by a flexible strap 88 (FIG. 1) that allows the required pivoting movement. The other end of the crossbar is supported above its respective post upper end by a spring assembly comprising a vertically extending screw threaded rod 90 that passes freely through a bore in the crossbar end. The end is suspended between a pair of compression springs 92, the compressions of the springs and the corresponding vertical position of the shaft 48 being adjusted as required by operation of a nut 94 at its upper end. Because of the knife edge pivot the motion of the horizontal shaft axis 50 will be in an arc about the axis 86, and such motion will vary the eccentricity of the relative rotation of the two mill members, thus varying the size of the line gap G. The spring assembly also ensures that the two mill members cannot be jammed against their relative rotation by any unusually large particles that enter the treatment zone. The shaft 48 is connected via a flexible coupling 95 to a motor by which it is driven.

The inner mill member 46 preferably is made entirely of a sufficiently hard material, such as silicon carbide, with its external surface 44 ground accurately and smoothly to the required limits, but it can instead comprise a cylindrical tube of the hard material mounted on a suitable interior frame. The outer cylinder can also be of the same material, but for economy can be of stainless steel with an insert 96 of the same hard material as the inner cylinder over its lowermost arc segment where the gap G is formed. The portion of the overall high-shear treatment zone containing and immediately adjacent the insert constitutes a subsidiary higher-shear treatment zone within the overall high-shear treatment zone and is the zone in which the majority of the milling action takes place, as will be discussed below. The two mill members are rotated eccentrically relative to one another, so that the gap G is smaller than the diametrically opposite gap H between the upper portion of the inner mill member and the opposed portion of the outer mill member. The annular passage 42 is therefore circumferentially alternately convergent from gap H to Gap G, at which the passage walls are spaced a minimum distance apart and the maximum shear is obtained in the flowing material; the passage is then divergent from gap G to gap H.

In this preferred embodiment the insert is of rectangular transverse cross section, so that the surface 98 thereof which provides the corresponding surface of the subsidiary higher-shear treatment zone gap is flat and the two cooperating mill surfaces are counterformal (also sometimes referred to as non-conformal), so that their convergence and subsequent divergence in and immediately adjacent to the gap is much greater than over the remainder of the overall high-shear treatment zone . The surface 98 is also ground accurately and smoothly to the required limits.

Figure 4:
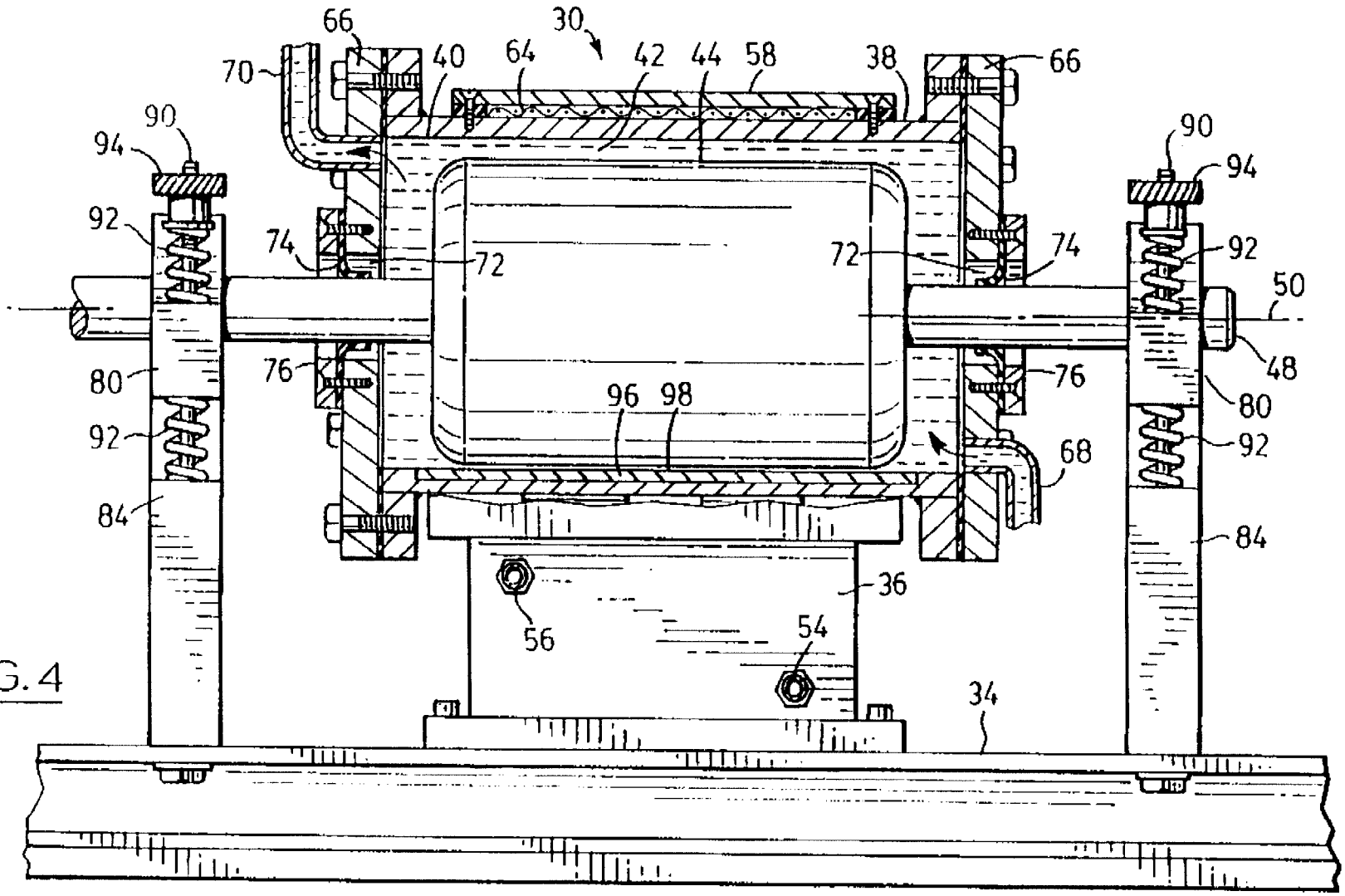
FIG. 4 is a partial side elevation and partial longitudinal cross section of the drum mill of FIGS. 1 and 2, the mill base and inner mill member being in side elevation, while the outer mill member is in longitudinal cross section taken on the line 4—4 in FIG. 2.

In another embodiment illustrated by FIG. 4 the cooperating mill surfaces 44 and 98 are instead conformal, i.e. they are so closely matched in contour and dimensions that they are separated by only a small gap over a relatively large area, the inner milling surface 98 of the insert being ground to the necessary concave profile and smoothness; the convergence and divergence of the two surfaces at the treatment zone is then due solely to the eccentricity of the two surfaces. The flat surface 98 of the embodiment of FIGS. 1–3 can be regarded as being of infinite radius, and it can be given any required value between flat and the conformal value of the embodiment of FIG. 4.

Typical fine powder materials that will be processed using the apparatus of the invention are alumina, silica and zirconia, all of which are available commercially as agglomerated primary particles of 5 micrometers or less, and particularly are available as agglomerated primary particles of the nominal size range 0.3–1 micrometer, the agglomerate sizes being as large as 200 micrometers. The quantities of the powdered material and the functional additives that are introduced into the dispersion vehicle will of course depend upon the purpose of the slurry, but usually it is desired to keep the quantities of both the dispersing vehicle and the additives as low as possible to facilitate subsequent processing. Its consistency needs to be kept relatively thin to prevent dilatency that can be obtained with such materials.

In a specific embodiment intended for the processing of ceramic slurries, in which the maximum required particle size is one micrometer, the inner member 46 is of 15 cm (6 ins) length and diameter and is rotated at speeds in the range 200–2000 rpm, preferably 400–600 rpm. The circumferential width of the insert 96 is about 2.5 cm (1 in). When used for milling the size of the gap G will usually be the maximum particle size of the powder material after being ground, and for most ceramic slurries therefore it will vary in the range 0.1–5 micrometers, more usually in the range below 2 micrometers. A somewhat larger gap may be necessary if the slurry is particularly viscous so as to obtain an adequate flow through the mill. The use of longitudinal pressure oscillations permits the gap to be somewhat larger, as will be explained below. Although the processes and apparatus of the invention are particularly and unusually effective with materials incorporating such fine particles, they are still operative advantageously with materials of larger particle size. The gap G will therefore vary in the range 1–500 micrometers, preferably in the range 1–100 micrometers, as will be discussed below, while the diametrically opposed gap H will have a maximum value of about 5 mm (0.20 in). The gap sizes when the mills are employed as dissolvers, reactors or mixers are discussed below.

Figure 6:
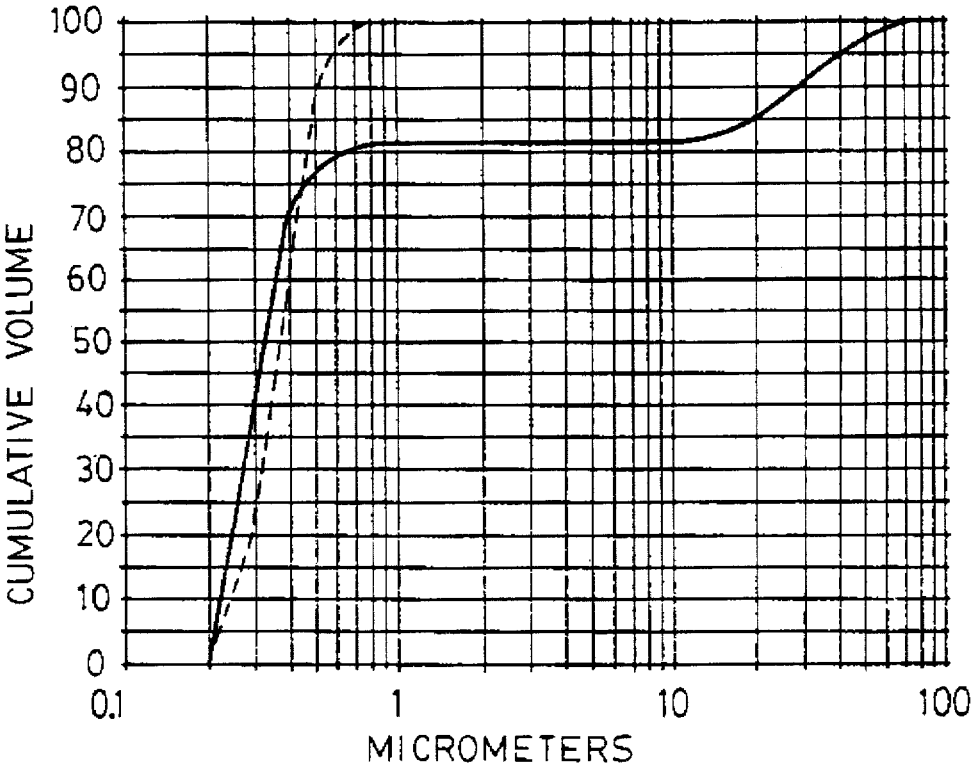
FIG. 6 is a particle size distribution cumulative graph showing as a solid line the particle distribution of a predispersed zirconia slurry, and as a broken line the particle distribution after processing using the plate mill of FIG. 11.
Figure 11:
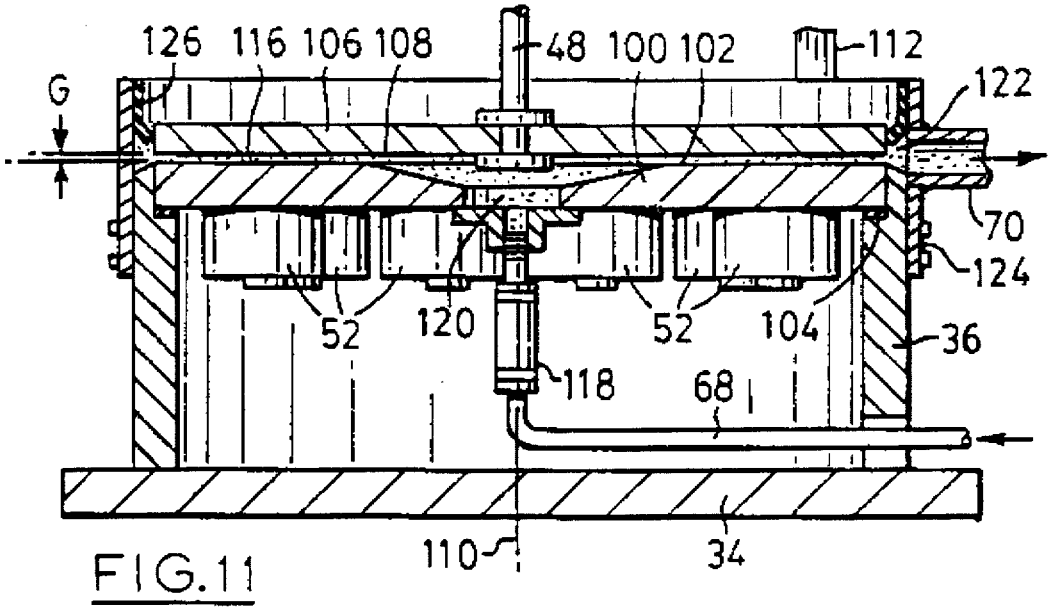
FIG. 11 is a vertical transverse cross section similar to FIG. 2 of a plate mill which is a still further embodiment.

An example of the effectiveness of the methods and apparatus of the invention is given by FIG. 6, which is a combined cumulative graph showing in solid line the particle size distribution of a pre-dispersed slurry material, and in broken line the distribution of the same material after processing in the plate mill of FIG. 11. The material employed was spray dried, partially stabilised zirconia of nominally 0.3 micrometer particle size that had been pelletized using a water soluble binder to prevent dusting and to permit its ready transport, the pellets being 100–150 micrometer in size. Fifty (50) grams of these pellets were predispersed for 30 minutes in 100 grams of water with a small amount of a surfactant (0.3% by weight of the zirconia) using an ultrasonic bath, which should have been sufficient to fully deagglomerate the raw powder. The solid line characteristic shows that in the material after such processing only 82% is of a size smaller than 0.8 micrometers, there is virtually no material of size between 0.8 and 10 micrometers, and the remaining 18% is of size between 10 and 80 micrometers. This is partly the result of agglomeration, but mainly the result of hardening of the pellets, making them difficult to restore to the original particle size without complete expensive remilling of the material. The broken line characteristic shows the result of processing the same material in the plate mill for the same period of 30 minutes; it will be seen that all of the material is below 0.8 micrometers, 99.25% is below 0.7 micrometers, and 96% is below 0.6 micrometers.

The following discussion of the methods and apparatus of the invention constitute an attempt to provide an explanation based on current knowledge of the new and unexpected mechanisms which result in the new and unexpected improved performance and operation. Therefore I do not intend to be bound by this explanation in that further investigation may show that other new and unexpected mechanisms are instead or also responsible.

As was described above, it is well known to those skilled in the production of ceramic slurries that with small particles, even with high-power, high-shear, mixers a relatively long period of "aging" is required to obtain complete dispersion, and this period is not shortened appreciably by increases in mixing power, or by increasing the speed of rotation of the stirrer so as to increase the shear velocity. A study by Dr. A. N. Kolmogoroff of such mixing processes gave what appears to be a possible explanation for this, and for the fact that initially the mixing proceeds rapidly but then slows dramatically. He showed that the mixing depends upon the production of eddies, and that with conventional mixers using, for example, water as the dispersion vehicle and at a temperature of 20° C., it is impossible to obtain eddies of diameter smaller than about 10 to 20 micrometers. Liquid elements and entities, such as entrained particles, of smaller size than this become part of these smallest eddies and are thereby shielded against the effect of turbulence, so that any mass transfer is no longer governed by convection but by the much slower molecular diffusion within the eddies as a result of internal concentration gradients. The smallest movement that can be regarded as an eddy (a Kolmogoroff eddy) and that could be produced by these mixers would be obtained when the local Reynolds number approaches and equals unity, and for such small eddies at low Reynolds numbers viscous forces are more important than inertial forces.

On the assumption that Kolmogoroff has provided a satisfactory explanation for this phenomenon, in the methods and apparatus of the invention the spacing of the walls of the flow passage, at least in the overall high-shear treatment zone, is such as to allow the coexistence of free supra-Kolmogoroff eddies which are larger than the smallest Kolmogoroff eddy diameter for the flowing material and forced sub-Kolmogoroff eddies which are smaller than the smallest Kolmogoroff eddy diameter. The overall high-shear treatment zone includes at least a portion thereof in which the passage spacing is smaller than in the remainder of the zone to provide a subsidiary higher-shear treatment zone in which the free supra-Kolmogoroff eddies are suppressed. One important result of this limitation is that the flow through the subsidiary higher-shear treatment zone must be laminar and therefore non-turbulent. In this embodiment the linear axially extending gap G, comprising the portion of the flow passage of minimum wall spacing, constitutes the subsidiary higher-shear treatment zone, while the overall high-shear treatment zone comprises all of the flow passage in which the prescribed maximum spacing is obtained.

Kolmogoroff also showed that in a system with isotropic turbulence, when the distribution of eddies has come to equilibrium, the eddy diameter (usually referred to as the eddy length) expressed as $L_K$ can be determined in terms of the power input to unit mass ($P_M$) of the stirring system by the relation:

$$L_K=(v^3/P_M)\text{hu} \quad 14$$

where v is the kinematic viscosity of the fluid. This restriction of the flow passage therefore has an important additional unexpected beneficial effect on the efficiency of power utilisation of the new mills; in a conventional prior art system most of the turbulence energy resides in the large and medium size eddies and very little in the small eddies of size of the order of $L_K$, so that most of the power of the system has been dissipated uselessly in the production of eddies that are only effective to maintain the initial dispersion, while the remaining "aging" dispersion is produced by the molecular diffusion. With the methods and apparatus of the invention in the overall high-shear treatment zone, and particularly in the subsidiary higher-shear treatment zone, only eddies equal to or smaller than the minimum can be generated, while useless larger eddies are suppressed. The relation also shows that any increase in viscosity of the fluid normally results in an increase in eddy diameter; the considerable increases in viscosity that do occur are discussed below, but any consequent increases in eddy diameter are again prevented.

The slurry moves axially in the annular flow path constituted by the passage 42 under the urge of its respective pump 26, which operates at a relatively low pressure, e.g. usually in the range 0.07–0.7 Kg/sg.cm. (1–10 p.s.i.). Under the effect of surface energy forces the flowing material forms respective thin adherent films on the surfaces 40, 44 and 98, each of which films includes a respective boundary layer. The gap H will usually be sufficiently large that these two films are separated by an intervening layer, which has a maximum thickness at the gap H and which decreases progressively in thickness to a minimum in the line processing gap G, at which the maximum shear conditions are obtained. The gap G may be so small that a layer identifiable as an intervening layer is no longer present and the flow therefore consists of the two thin films which intercept one another. The gap may also be so small that it is possible to regard the films as consisting only of the two boundary layers which intercept one another.

In accordance with the invention the two mill members are moved relative to one another so as to move the flow passage walls relative to one another transverse to the flow direction and at a relative speed such as to force the simultaneous development in the overall high-shear treatment zone of both supra-Kolmogoroff and sub-Kolmogoroff eddies in the flowing material while maintaining the integrity of the respective films, and also maintaining the flow in the subsidiary higher-shear treatment zone non-turbulent, so that the two films can interact with one another to produce the desired milling action. If the gap H is large enough, which in practice will usually be the case, as the two surface adherent films are dragged by the relative rotation of the mill members out of the gap G and toward the gap H they are separated and fresh material enters between them to form an intervening layer in which supra-Kolmogoroff eddies can be established, whereupon macro-mixing can take place in this part of the passage, only to have the films move together again to eliminate the intervening layer, to suppress the supra-Kolmogoroff eddies, and to force their conversion to sub-Kolmogoroff eddies, this cycle repeating with each rotation of the inner mill member 46. The material is therefore treated in the overall high-shear treatment zone on a supra-micron and sub-micron scale to produce the desired thorough uniform mixing, while an even more intense and thorough uniform mixing is produced in the subsidiary higher-shear treatment zone, together with uniform grinding and deagglomeration to an extent that it is believed has not been possible with prior art milling systems.

It is believed that an understanding of the new methods and apparatus of the invention is facilitated by considering that attempts hitherto to mill fine particles have been what may be characterised as three-dimensional "volume" systems, in that the body of the mill comprises a large volume container big enough to contain a stirring mechanism or a milling medium. Balls, beads and even sand are used as the milling media, but the mills are relatively inefficient since in order to be ground the material particles must be present between the contacting point areas of the colliding media elements, and statistically this is an infrequent event which becomes even more infrequent as the particles are reduced in size. As has also been explained the possibility of contamination is also high, e.g. frequently as much as 0.2% by weight, which is unacceptable in that the maximum value for most electronic ceramic applications is 0.01%. By contrast, my process and apparatus must be regarded as a two-dimensional "area" system in that at least in the subsidiary higher-shear treatment zone, even if a thin intermediate layer is present, any possibility of turbulence has been eliminated by making it impossible to establish supra-Kolmogoroff eddies. It is an inherent characteristic of such thin non-turbulent surface films, and particularly of their boundary layers, that almost independently of the actual viscosity of the material passing in the flow path, they act as very viscous liquid skins that hold firmly entrained any fine particles that are therein. The relative transverse movement of the two mill members then forces these firmly entrained particles into milling engagement with each other, and with the mill member surfaces, to produce the superior results as illustrated by FIG. 6.

In further possible explanation, it is known from tribology, the study of friction and wear of engineering materials, that a lubricating layer that is hydrodynamic is produced between two relatively moving conformal surfaces that converge and are subjected to a load, and the lubricant forming such a layer has a viscosity greater than that of the unloaded material. Such a layer is formed by the adherent films obtained in the mills of FIGS. 1–4, so that the local viscosity of the slurry will increase in the overall high-shear treatment zone, and particularly in the subsidiary higher-shear treatment zone with its minimum gap G, which will augment the uniform mixing and grinding action in these zones. Further increases in local viscosity, without long-term effect on the overall viscosity of the slurry material, can be obtained if the films are also made to be elastohydrodynamic, as will be explained below. It is known to those skilled in the art that the breakup of particle agglomerates is very effective when a high shear rate smearing action encounters strong viscous resistance, the deagglomeration becoming more effective as the resistance increases. To achieve the required high viscosity conventional processes use either a dispersing liquid of high viscosity, or the highest possible solids volume fraction. The present invention instead obtains the desired viscosity increase by a localized tribological hydrodynamic and/or elastohydrodynamic effect within the narrow boundaries of the overall high-shear treatment zone, and particularly within the subsidiary higher-shear treatment zone, without the need for special selection of the proper high liquid viscosity or high solids volume fraction.

The degree of convergence required for the two surfaces is quite small and the ratio of minimum to maximum film thickness in the treatment zone is in the range 1:2 to 1:50, preferably in the range 1:2 to 1:10. Too great a degree of convergence is to be avoided, since there is then the opportunity for counterflow to be established upstream of the zone that entrain the particles, particularly the larger particles, and prevent them from being drawn into the zone for processing.

In view of the small values required for the spacing of the mill surfaces in the overall high-shear treatment zone, and particularly in the subsidiary higher-shear treatment zone, the operative surfaces 40, 44 and 98 must be ground to corresponding degrees of smoothness and curvature (or flatness in the case of a plate mill) if asperity surface contact and film disruption is to be avoided. The relation M between film thickness F and surface roughness R may be expressed by equation $M=F/R$, and in practice M should have a value in the range 1–5, preferably 2.5–3. For example, if the mill is to produce deagglomeration to 1 micrometer or less, and the value of M is to be maintained at 3, then the surface roughness should be 0.33 micrometer or less, which is a dull mirror finish or a good polish. Coarser finishes are permissible for mills that act as reactors, mixers or dissolvers. The mill surfaces can be diamond coated to increase their abrasion resistance and the diamond layer can be either crystalline or amorphous; it can be applied by ion implantation or some other method that will not change the profile of the original surface.

The processes and apparatus of the invention can be operated without the aid of longitudinal pressure oscillations and are able to do this by its new and unexpected use of high-shear conditions, e.g. high-shear comminution, in a high viscosity liquid/solid system. As described above, tribology teaches that liquids suddenly increase their viscosity when they enter the compressed state in the minimum gap in a counterformal journal bearing. This effect is put to use in the invention by providing an overall high-shear treatment zone in which uniform mixing can take place, and which includes a subsidiary higher-shear treatment zone including a minimum gap between counterformal surfaces with a corresponding highest shear zone in which the viscosity is increased substantially but only locally. This provides high shear comminution and dispersion in such tribologically defined zones without the need to raise the viscosity of the feed material prior to entering the mills by using for example thick binders, thickening additives, or by adding more solids.

It is believed that an explanation of the unexpectedly beneficial effects of the use of longitudinal pressure oscillations can, also unexpectedly, be that the processes are two-dimensional "area" processes, and by the teaching of tribology concerning what is known as the squeeze-film effect obtained when two relatively moving fluid coated surfaces also have considerable perpendicular movement toward and away from one another. Thus, it is known that if two cooperating surfaces separated by a thin layer of fluid are counterformal, as are the surfaces 40 and 44, and particularly the surfaces 98 and 44, so that they involve a nominally line-shaped gap, (e.g. the gap G), and are subjected to such perpendicular movement, then the local pressures and viscosities in the gap will generally be much higher than those generated hydrodynamically, and are regarded as being generated elastohydrodynamically. Prior examples of this type of structure are meshing gear teeth and a ball or roller in its track in a bearing, all of which are lubricated. As calculated using hydrodynamic theory the lubricant layers will be so thin that the perpendicular movements should cause asperity contact between the surfaces, whereas it is found in practice that thicker than predicted layers are produced, and the integrity of the surface films is maintained, so that they remain continuous.

The explanation given by tribology is that the local very high pressure oscillations considerably increase the viscosity of the fluid over that predicted by hydrodynamic theory, and instead of an increase of only a few percent the resultant local pressure and viscosity in the gap can be very high indeed when elastohydrodynamic conditions prevail. For example, pressures of 500 MPa are obtained and at this pressure the viscosity of a lubricating oil can be more than 20,000 times that of the same material at atmospheric pressure, and it will behave much more like a solid than a liquid. The cyclic loading of the stationary mill member relative to the moving mill member by the oscillations produces a corresponding precise, cyclic perpendicular movement or displacement, with a consequent loading and pressure effect, particularly in the gap G, that results in the squeeze-film effect, independently of the hydrodynamic effect, with corresponding unexpectedly high increases in the local viscosity of the flowing material, and a consequent considerable enhancement of the milling action between the highly viscous surface films. It will also be seen that this is a new and unexpected use of longitudinal pressure oscillations, in that they are producing a direct mechanical effect on the relatively moving mill parts, and an indirect mechanical effect by pressure and viscosity increase in the thin cooperating flowing films, that is completely different from the effect of directing such oscillations into a relatively large volume of liquid, as with the above-described known prior art attempts. Thus this beneficial effect of the longitudinal pressure oscillations is not due to any direct effect they may have upon the solid particles entrained in the liquid vehicle, but is instead due to its unexpected indirect effect upon the pressure and viscosity of the liquid vehicle. The local increases in viscosity in the flowing material due to the squeeze-film effect also ensures that the integrity of the adherent surface films is maintained, and they do not become disrupted by the high content of solid material which they contain, and despite the very narrow passage wall spacings employed.

Another effect of the use of the longitudinal pressure oscillations is that the perpendicular movements of the passage wall reduces the effective height of the flow passage, so that it performs, insofar as the grinding is concerned, as if it were smaller. In this case for example when a maximum particle size of 1 micrometer is required the gap G can be set to be somewhat larger, to as much as 2 micrometers with the same result. This explanation of the use of longitudinal pressure oscillations does not exclude that they may also be acting directly to simultaneously produce even smaller sub-Kolmogoroff eddies which are able to interact with the larger eddies for an unexpected synergistic and beneficial effect in mixing and milling.

The methods and apparatus of the invention may therefore also be regarded as employing a combination of "macromixing" the flowable material to obtain as much uniformity as possible in the overall high-shear treatment zone, which is that portion of the passage between the two relatively moving surfaces which are sufficiently closely spaced and are moved relative to one another at sufficient speed, and simultaneously "micromixing" by the application of reverbatory longitudinal pressure oscillations to force the production of smaller sub-Kolmogoroff eddies.

The apparatus may also be regarded as functioning by surface action or "skin-drag" of the rotating outer surface 44 of the inner cylinder 46, which captures a thin film of the slurry and drags it with it into engagement with the thin film that is present on the surface 98 of the insert 96. The rate of flow of the slurry through the mill is made such that all of it will be dragged by the rotating surface 44 through the milling gap G, despite the presence of the larger gap H at the upper part of the mill, which may appear from the drawing as though it would short circuit the milling gap; however, as explained above, in this embodiment the maximum value of this gap is only 5 mm, and is more usually of the order of 1 mm, and this is sufficiently small to ensure that with the correct choice of flow rate the desired passage of all of the material through the treatment zone will be achieved.

Figure 5:
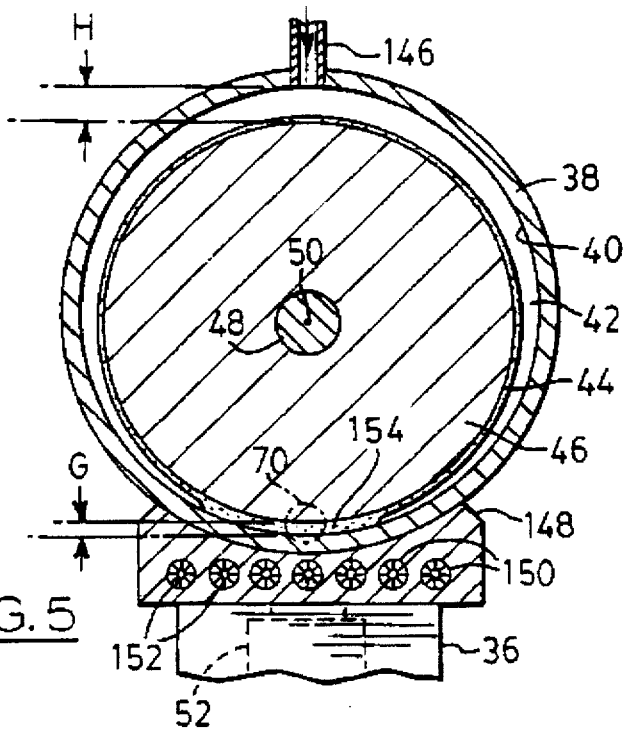
FIG. 5 is a transverse cross section similar to FIG. 2 through a drum reactor for gas-liquid reactions in accordance with the invention.

FIG. 5 shows apparatus according to the invention for carrying out otherwise difficult to perform chemical reactions and physical inter-actions, such as the reaction of a gas with a liquid, or the rapid solution or reaction of a difficultly soluble gas in or with a liquid. This apparatus also consists of an inner cylinder 46 rotating about a horizontal axis 50 within a hollow outer cylinder 38. The carrier liquid to be reacted, or to act as the solvent, is fed through the reactor from a liquid inlet (not shown) at one end to a liquid outlet 70 at the other end, with the difference that in this embodiment both the inlet and the outlet are disposed at the lowermost part of the outer cylinder, while the other component is fed into the action/reaction space between the two cylinders by a separate inlet 146, no separate outlet of course being required since it is being consumed by the carrier liquid. A coupling member 148 interposed between the transducers 52 and the mill member 38 is provided with passages 150 for cooling or heating liquid, depending upon whether the action/reaction taking place in the reaction gap is exothermic or endothermic, these passages being provided with heat exchange enhancing inserts 152, as disclosed for example in my U.S. Pat. No. 4,784,218, the disclosure of which is incorporated herein by this reference. The liquid component is fed at a rate to ensure that a liquid pool 154 is formed confined to the space between the relatively rotating members immediately adjacent to the ultrasonic transducers.

The minimum gap G can be of greater height than the milling gap of the previously described embodiments and can be in the range from 1 micrometer to 5 mm, while the opposite gap H can be in the range from 2 mm to 2 cm. The rate of relative movement of the two surfaces will also usually be much higher than for grinding and, for example, with an inner cylinder of 15 cms (6 ins) diameter the rotational speed will usually be in the range 200 to 20,000 rpm, with a preferred range of 500–5,000 rpm. Mill members of smaller or larger diameters will operate at correspondingly different speeds in order to obtain equivalent angular velocities. An upper limit for the highest possible speed may be set by the possibility of lack of stability in the materials being processed, especially long chain molecules, and by the onset of cavitation. For some applications the two mill members may be operated coaxially, when the whole of the annular passage 42 constitutes both the overall high-shear treatment zone and the subsidiary higher-shear treatment zone, the two zones then being coextensive.

Although both of the embodiments of FIGS. 1–5 have the axis 50 of relative rotation horizontal, they can also be operated with the axis in other orientations, particularly vertical.

Figure 7:
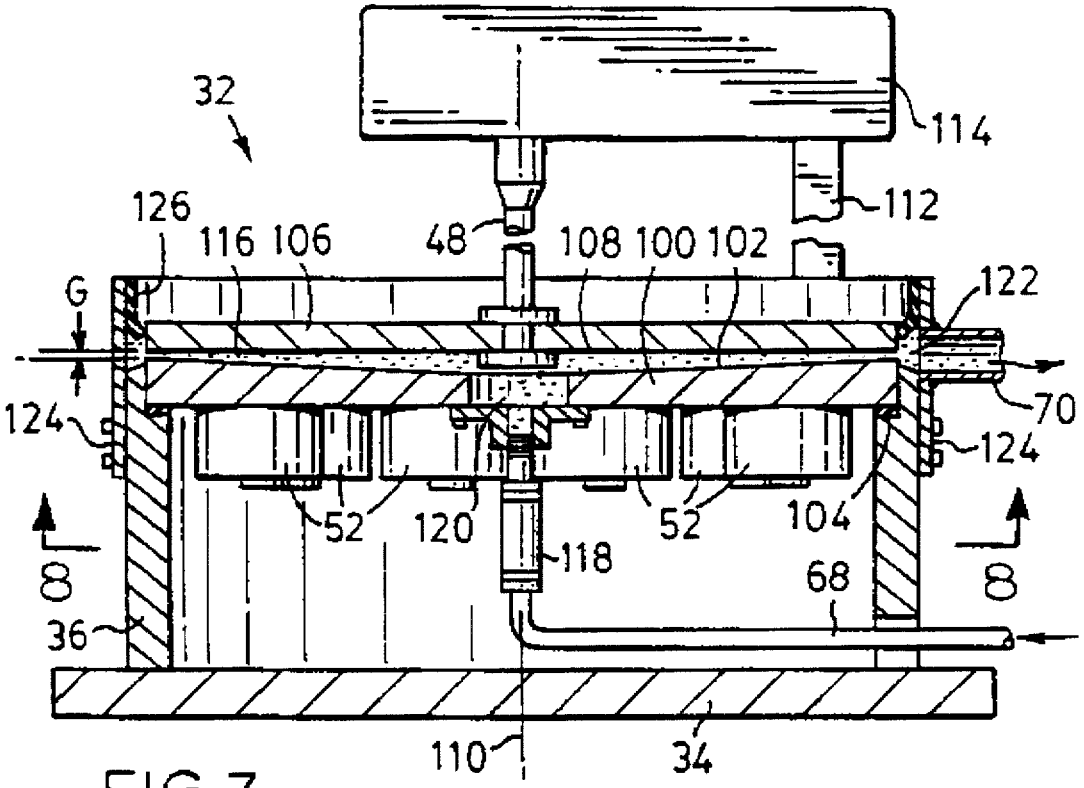
FIG. 7 is a vertical transverse cross section taken on the line 7—7 in FIG. 8 of a plate mill which is a further embodiment, and in which the mill members rotate relative to one another about a vertical axis.
Figure 8:
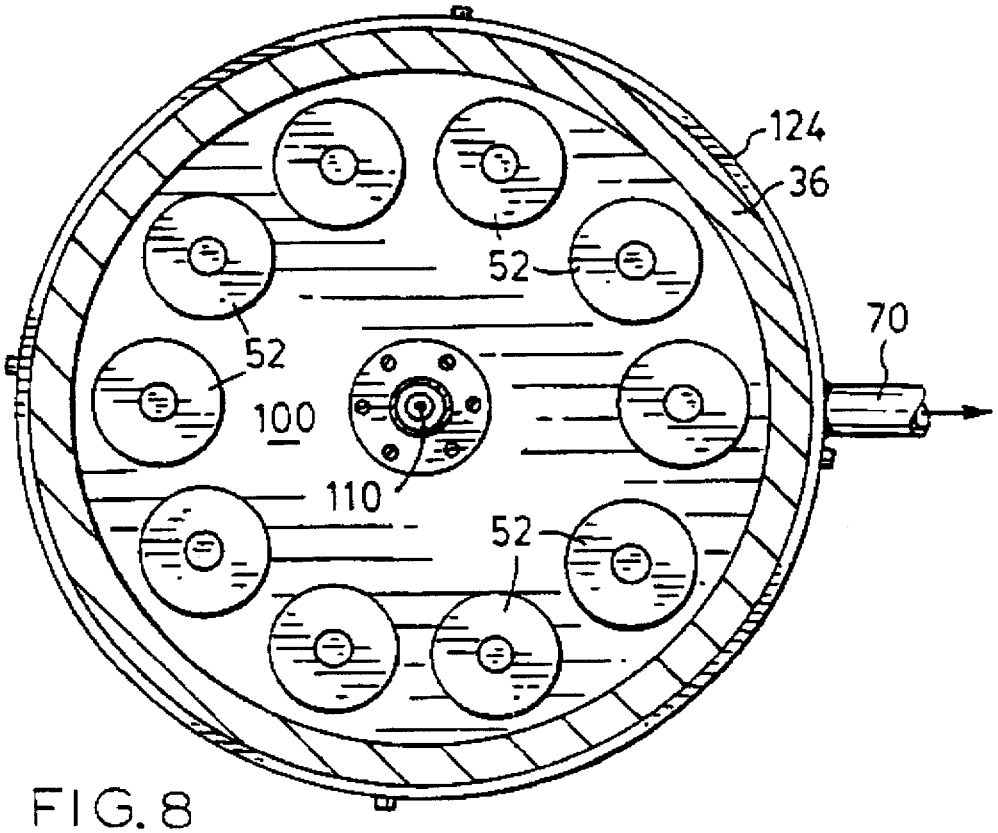
FIG. 8 is a horizontal cross section through the plate mill of FIG. 7, taken on the line 8—8 therein.

Referring now particularly to FIGS. 7 and 8, a plate mill 32 shown therein comprises an apparatus base plate 34 supporting a cylindrical base casing 36. A stationary circular vibratory plate member 100, corresponding to the drum mill member 38 and having a circular surface 102 corresponding to the drum surface 40, is securely mounted on a ring or annulus 104 of resilient material, for example by being cemented thereto, and this annulus is in turn securely mounted in a counterbore, for example by being cemented therein, provided at the upper end of the casing 36, so that the plate is securely mounted thereon. A small radial clearance is provided between the cylindrical edge of the plate 100 and the facing cylindrical wall of the counterbore, so that it can vibrate freely vertically, but is constrained against any appreciable transverse motion. The plate is vibrated by a plurality of ultrasonic transducers 52 attached to its underside and uniformly circumferentially spaced about the plate centre point, the transducers being connected to a suitable electrical power source (which is not shown) for synchronous, in-phase operation, as with the transducers of the drum mill.

A circular rotatable plate member 106 corresponding to the drum member 46, and having a circular surface 108 corresponding to the drum surface 44, is mounted above the plate 100 for rotation about a vertical axis 110 that passes through its centre point by drive means comprising a vertical standard 112 attached to the base plate 34. A motorised drive head 114 is mounted on the standard and has a drive shaft 48 extending vertically downward therefrom, the plate member 106 being attached to the lower end of the shaft at its respective centre point so as to rotate therewith. The spacing between the plate member surfaces 102 and 108 of flow passage 116 is accurately adjustable, either by moving the head 114 vertically on the standard, and/or by moving the shaft 48 vertically in the head, using any suitable micrometer system, as will be well known to those skilled in the art. The plate member 106 is pressed strongly downward, either by suitable spring or weight means applied via the drive head and the shaft 48, in order to maintain the flow passage spacing at the desired value in the presence of the material flowing between them. It will be seen that in this embodiment the surface 102 is concave upward in the form of a highly flattened, straight-sided cone, so that the flow path passage 116 decreases progressively in height from the axis 110 radially outward. The portion of the flow passage in which the spacing is sufficiently small and the relative speed of rotation is sufficiently high thus constitutes a convergent overall high-shear treatment zone, while the radially outer portion of the passage including the minimum height processing gap G constitutes the subsidiary higher-shear treatment zone within the overall zone. In this embodiment the gap G is formed between the radially outer edges of the two plates, constituting a circular line zone in which the highest shear conditions are obtained, although in other embodiments, as exemplified by the embodiment of FIG. 9 to be described below, the gap may be located just radially inward of the radially outer edges. In other embodiments the surface 108, or both of the surfaces 102 and 108, can be suitably shaped to obtain the same effect.

The coarsely pre-mixed and pre-dispersed slurry is fed into the mill via an inlet pipe 68, which includes a flexible connection 118 so as not to interfere with the vibrations of the plate 100. The slurry enters between the plate members through a cylindrical hole 120 in the centre of the plate 100, this hole thus being the inlet to the flow passage 116, and flows both radially outward in the passage under the effect of the pump pressure, and also circumferentially as the result of the relative rotation of the mill members. Eventually the slurry reaches the cylindrical gap G, the outlet from which constitutes the outlet from the passage, and enters an annular outlet plenum chamber 122 formed between a cylindrical extension 124 of the casing 36, the plates 100 and 106, and a stationary annular elastomeric self-sealing gasket 126 attached to the casing 36 and engaging the moving edge of the rotating plate 106; the slurry then discharges from the mill via the outlet pipe 70.

During its flow in the passage 116 the slurry is subjected both to the effect of the close and progressively decreasing spacing between the passage surfaces, the relative rotation between the two plate members, and also to the effect of the longitudinal pressure oscillations or vibrations from the transducers 52, these effects combining as has been discussed above for the drum mill to produce within a much reduced period of time a much more complete uniform dispersion and wetting of the solid powdered material entrained in the slurry, together with the desired highly uniform milling, deagglomeration and comminution thereof, than has been possible with conventional high shear mixers and mills.

In a particular preferred embodiment the two plate members are both of 25 cm (1O ins) diameter and of 6.25 mm (0.25 in) thickness, and are of silicon carbide, preferably diamond coated on their facing surfaces, both surfaces having a mirror finish and in this embodiment preferably being flat to a limit of 1.5 micrometers over 25 cms. Flatter surfaces are possible, but in this particular embodiment are not necessarily economical or essential. The range of flatness preferred for the apparatus of the invention, depending upon its particular application, is from 500 nanometers to 10 micrometers per 25 cm.

The maximum height of the vertical spacing between the two plate surfaces is of course indefinite, since they will usually need to be separated for maintenance and inspection, while the minimum height of the gap G during operation will be as small a 1 micrometer or less, as with the drum mill, which is the processing gap that will usually be required for processing the smallest particle size slurries, while permitting an adequate flow of slurry between the plates. In normal operation the processing gap size is correlated with the average particle size of the slurry, and in a series of mills will be progressively smaller from the first to the last mill. The range of gap sizes to be employed is from 1 to 500 micrometers, while the usual range of gap sizes for the processing of powdered materials is 1–10 micrometers; the preferred range, especially for the processing of ceramic raw powders is 1–5 micrometers. The processing of any particular slurry will usually involve a particular protocol which inter-relates the process time and the passage height of the successive mills; thus the process is initiated in a mill in which the plates are relatively far apart in case any exceptionally large agglomerates are present, and the spacings subsequently are progressively reduced as the process continues and the particle size is reduced. It will usually be most effective to operate an individual mill with a relatively limited particle size range, and for example a mill with a feed in the range 0–100 micrometers will be employed to produce a product in the range 0–1 micrometer (0–1,000 nanometers), while one with a feed in the range 0–1.0 micrometer will be employed to produce a product in the range 0–0.2 micrometer (0–200 nanometers).

With a plate mill the relative circumferential linear transverse movement between the plates varies progressively from zero on the rotational axis 110 to a maximum at the circumferences, so that the required minimum threshold value will only be obtained at some radial distance from the axis. For the 25 cm (10 ins) diameter plates used in this embodiment the linear velocity of their operative surfaces relative to one another should be between 0.5 and 200 meters per minute (20 and 8000 inches per minute); in this specific embodiment measured at a mean radius of 6 cm (2.5 ins) the rate of rotation of the upper plate should be between about 1 and 400 revolutions per minute, while the preferred rate is between 50 and 200 revolutions per minute. There is also the possibility of decreasing the cost of the plates 100 and 106 by forming the overall high-shear treatment zone with its highly polished and flat operative surfaces only at their annular outer portions.

As with the drum mill it is believed that the local increases in viscosity due to the hydrodynamic and elastohydrodynamic effects are major factors in the operation of the mill. The material clings to the two surfaces in the form of respective thin adherent films, and particularly in the subsidiary higher-shear treatment zone they may be so closely spaced that they engage one another without the presence of any intervening layer, and this relative motion between the two films is added to the radially outward flow of material in the passage due to the pump. The thin surface layers are very strong and resistant to squeezing by movement of the plates together, and therefore require the plate members to be relatively rigid and to be pressed strongly together in order to maintain them at the desired small spacing. Whether the transducers 52 are operating to produce the squeeze-film effect, or whether they are operating to generate forced sub-Kolmogoroff eddies, or both, it is not necessary to provide transducers on both surfaces of the processing passage, avoiding the need to provide transducers and an electrical supply to the moving plate member. The size, number and spatial distribution of the ultrasonic transducers 52 will of course be specific for the particular mill, and as a specific example only, in the mill described herein ten transducers are provided uniformly spaced in a single circle. Each generator has an output of about 50 watts and operates in a range of frequencies 16 kHz to 50 kHz, which is the preferred range and is usually regarded as ultrasonic; the usual more extended range that will be used, depending upon the specific mill design, will be 8 kHz to 100 kHz, which extends below the ultrasonic.

Figures 9, 10:
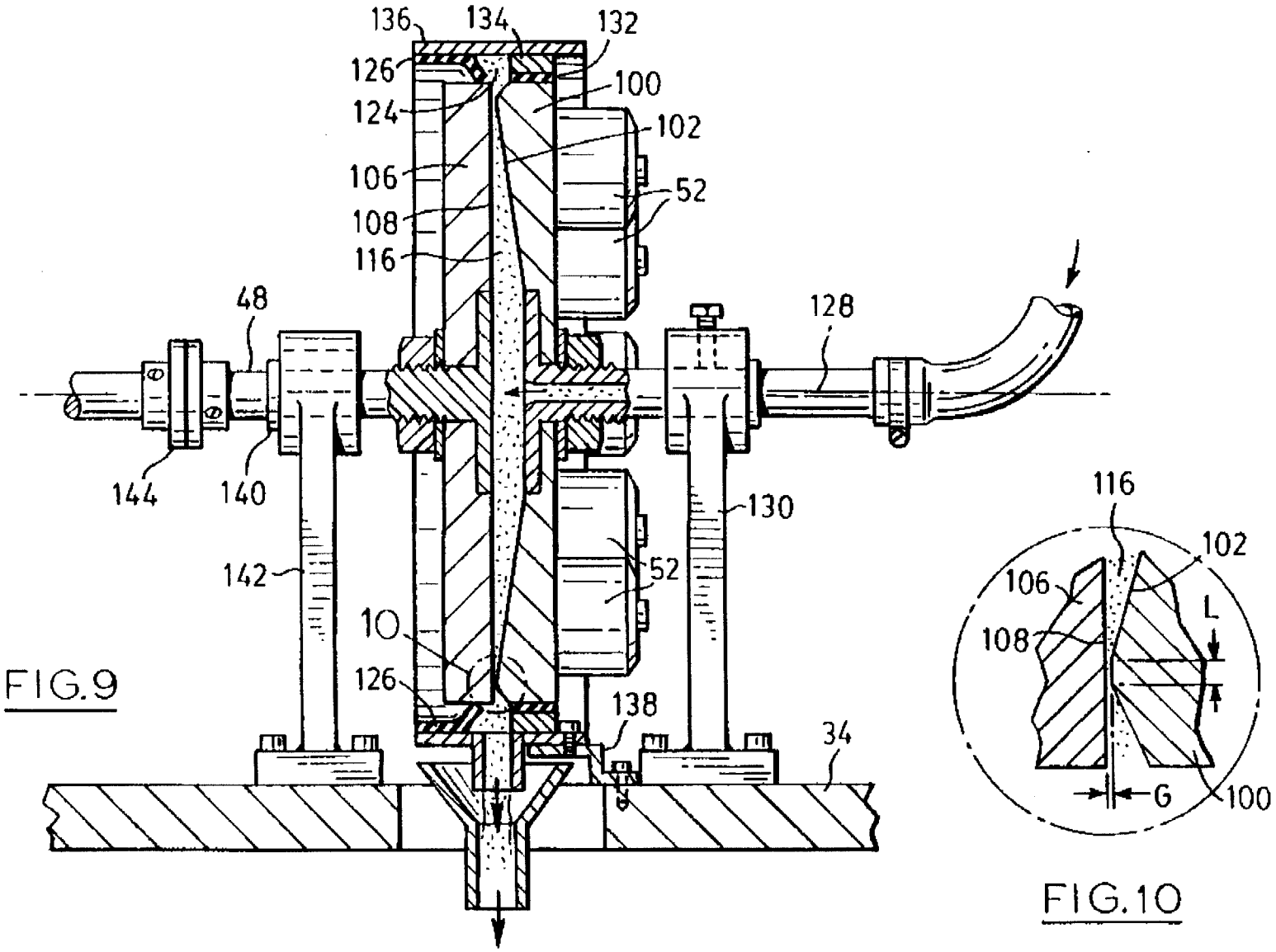
FIG. 9 is a vertical transverse cross section similar to FIG. 7 of a plate mill which is a still further embodiment of the invention, and in which the mill members rotate relative to one another about a horizontal axis.
FIG. 10 is an enlarged view of the portion 10 of FIG. 9 enclosed in a broken line circle.

FIG. 9 is a longitudinal cross section through another plate mill embodiment in which the two plate members are mounted for rotation about a horizontal axis 128. The stationary vibratory plate member 100 is securely fastened at the upper end of a standard 130 mounted on the baseplate 34 and has a cylinder 132 of resilient material fastened to its cylindrical periphery, which cylinder is in turn fastened to a steel ring 134 attached to an exterior casing 136; the casing is restrained against rotation by a strap 138. The outlet plenum 124 is formed between the cylinder 132, the ring 134, the casing 136 and the stationary gasket 126. The shaft 48 mounting the movable plate 106 about the axis 128 is mounted in a bearing 140 at the upper end of a standard 142 mounted on the baseplate 34 and is driven by a motor which is not shown via a coupling 144, which permits the necessary movement of the shaft and the plate along the axis 128 to vary the flow path height and to permit access to the flow passage 116 as required. The cross-section of the gap G is shown in greater detail in FIG. 10 and it will be seen that it is inward of the circumferential plate edges, and has a radial extent L, the passage thereafter widening axially to discharge smoothly into the plenum 124. The passage 116 of the embodiment of FIGS. 7 and 8 can also take the same form. In a particular embodiment the value of L will be 0.5–5 mm, preferably about 1 mm. The rotational axis can also assume other attitudes than vertical or horizontal since this has no effect upon the operation of the mill.

FIG. 11 illustrates an embodiment that was originally used in the production of the example which resulted in the graph of FIG. 6, and it will be seen that the mill surfaces 102 and 108 forming the flow passage are substantially parallel over most of the radial extent of the plates 100 and 106, so that there is no defined minimum gap G and in that respect they are conformal. The overall high-shear treatment zone therefore extends from the radial location at which they are rotating relative to one another at a sufficient speed to the radially outermost edges of the plates, and the subsidiary higher-shear treatment zone has the same radial extent, the two zones therefore being coextensive. In this embodiment therefore the spacing in the overall high-shear treatment zone flow passage is sufficiently small to meet the condition for the subsidiary higher-shear treatment zone that free supra-Kolmogoroff eddies are suppressed, and only forced sub-Kolmogoroff eddies are possible. Again, the respective surface films may be so thin that they consist essentially of only the highly viscous boundary layers that engage with one another. The relative rotation of the plates will produce a small hydrodynamic effect on the viscosity of the material as it is dragged circumferentially, and in this embodiment the transducers are found therefore to be particularly desirable in producing their beneficial elastohydrodynamic effect on the grinding ability of the mill. This was originally postulated as being due to the direct generation by the transducer oscillations of smaller sub-Kolmogoroff eddies in the material, superimposed on the sub-Kolmogoroff eddies produced by the relative rotation, but from the explanation above it is possible that both hydrodynamic and elastohydrodynamic effects are also operative. The synchronized and in phase operation of the transducers attached to the stationary mill member produces a strong, high frequency, precise movement or displacement thereof, causing a localized viscosity increase at least in the minimum gap G due to the elastohydrodynamic effect of the thus generated squeeze-film.

Due to the fact that in a plate mill all particles must pass through the ring-shaped minimum gap a plate mill will be preferred to a drum mill whenever particle size reduction is required and the the upper size limit of the particle size distribution must be maintained with certainty. Although the method and apparatus of the invention have been described predominately in their application to the treatment of ceramic slurries, it will be apparent that they are applicable generally to the uniform mixing of materials, such as the uniform mixing of two mutually non-soluble or difficultly soluble liquids, the solution of materials including gases in liquids, particularly fine particle materials and materials that are of low solubility in the liquid, and the suspension of other materials in suspension vehicles, especially materials that are difficult to wet, and particularly fine particle materials.

INDEX OF REFERENCE SIGNS

| | |
|---|---|
| G | Minimum Gap in Flow Passage |
| H | Maximum Gap in Flow Passage |
| L | Radial Extent of Gap G |
| 10 | Powder Supply Hopper |
| 12 | Premixing Circuit Storage Tank |
| 14 | Dispersion Vehicle Supply Tank |
| 16 | Premixing Circuit Circulating Pump |
| 18 | Premixing Circuit RUM |
| 20 | RUM Wall Plates |
| 22 | RUM Ultrasonic Transducers |
| 24 | Drum Mixer |
| 26 | Feeder Pumps |
| 28 | Coolers |
| 30 | Drum Mill of the Invention |
| 32 | Plate Mill of the Invention |
| 34 | Apparatus Base Frame |
| 36 | Intermediate Casing |
| 38 | Outer Cylindrical Mill Member |
| 40 | Inner Surface of Mill Member 38 |
| 42 | Drum Mill Annular Flow Passage |
| 44 | Outer Surface of Mill Member 46 |
| 46 | Inner Cylindrical Mill Member |
| 48 | Shaft for Mill Member 46 |
| 50 | Horizontal Axis of Shaft 48 |
| 52 | Mill Ultrasonic Transducer |
| 54/56 | Transducer Coolant Inlet/Outlet |
| 58 | Cover Plate to form Cooling Enclosure |
| 60/62 | Mill Coolant Inlet/Outlet Pipes |
| 64 | Wire Mesh Insert |
| 66 | End Cover Plates |
| 68/70 | Slurry Inlet/Outlet Pipes |
| 72 | Holes in End Plates 66 |
| 74 | Gasket Seals |
| 76 | Retaining Washers |
| 78 | Bearings for Shaft 48 |
| 80 | Crossbars Supporting Bearings 78 |
| 82/84 | Bearing Posts for Crossbar 80 |
| 86 | Crossbar Pivot Axis |
| 88 | Flexible Strap |
| 90 | Screw Threaded Rod |
| 92 | Compression Springs |
| 94 | Adjustment Nut |
| 95 | Drive Coupling |
| 96 | Insert for Mill Member 46 |
| 98 | Milling Surface of Insert 96 |
| 100 | Stationary Circular Plate Mill Member |
| 102 | Mill Surface of Plate Member 100 |
| 104 | Resilient Mounting Annulus for Member 100 |
| 106 | Rotatable Circular Plate Mill Member |
| 108 | Mill Surface of Plate Member 108 |
| 110 | Plate Mill Vertical Axis |
| 112 | Mill Standard |
| 114 | Motorised Mill Drive Head |
| 116 | Plate Mill Flow Passage |
| 118 | Flexible Pipe Connection |
| 120 | Central Hole in Plate 100 |
| 122 | Outlet Plenum Chamber for Slurry |
| 126 | Plenum Resilient Gasket |
| 128 | Horizontal Mill Rotational Axis |
| 130 | Standard |
| 132 | Resilient Cylinder |
| 134 | Steel Ring |
| 136 | External Casing |
| 138 | Restraining Strap |
| 140 | Bearing |
| 142 | Standard |
| 144 | Coupling |
| 146 | Separate Inlet for Dissolver |
| 148 | Coupling Member between Members 36 and 38 |

-continued

| INDEX OF REFERENCE SIGNS | |
|---|---|
| 150 | Passages for Cooling Liquid (FIG. 5) |
| 152 | Heat Exchange Inserts |
| 154 | Liquid Pool |

I claim:

1. Methods for high-shear treatment of flowable materials comprising at least two components, one of which is a liquid, the methods comprising:

passing the material to be treated in a flow direction in a flow path constituted by a passage between two closely spaced passage surfaces provided by respective mill members, the passage having an inlet thereto and an outlet therefrom;

wherein:

the flow path includes an overall high-shear treatment zone in which the spacing between the passage surfaces allows the coexistence of free supra-Kolmogoroff eddies which are larger than the smallest Kolmogoroff eddy diameter for the flowing material and forced sub-Kolmogoroff eddies which are smaller than the smallest Kolmogoroff eddy diameter;

the overall high-shear treatment zone includes at least a portion thereof in which the passage spacing is smaller than in the remainder of the zone to provide a subsidiary higher-shear treatment zone in which free supra-Kolmogoroff eddies are suppressed during passage of the material therethrough; and while the material is moving in the overall high-shear treatment zone the mill members are moved relative to one another to thereby move the mill passage surfaces relative to one another in a direction transverse to the flow direction at a relative speed such as to force the simultaneous development of supra-Kolmogoroff and sub-Kolmogoroff eddies for the treatment of the material therein on a supra-micron and sub-micron scale with maintenance of the respective liquid films on the relatively moving passage surfaces, so as to thereby render the treated material as uniform as possible;

such relative movement producing in the subsidiary higher-shear treatment zone only forced sub-Kolmogoroff eddies with maintenance of non-turbulent flow.

2. A method as claimed in claim 1, wherein the subsidiary higher-shear treatment zone includes a gap (G) of minimum spacing between the passage surfaces towards which the passage surfaces spacing decreases for the generation of hydrodynamic pressure in the flowing material and resultant local increase in viscosity in the material for enhancement of the treatment action.

3. A method as claimed in claim 2, wherein the overall high-shear treatment zone includes also a gap (H) of maximum spacing between the passage surfaces towards which the passage surfaces spacing increases and the relative movement between the passage surfaces produces cyclic changes in the passage surfaces spacing.

4. A method as claimed in claim 3, and for use in the mixing of the material and/or entrainment of a component in a carrier liquid, wherein in the gap G the spacing between the closely spaced passage surfaces is in the range 1 micrometer–5 mm, and in the gap H the spacing between the closely spaced passage surfaces is in the range 2 mm–2 cm.

5. A method as claimed in claim 1, wherein in the overall high-shear treatment zone the spacing between the closely spaced passage surfaces is in the range 0.1–500 micrometers.

6. A method as claimed in claim 5, wherein in the subsidiary higher-shear treatment zone the spacing between the closely spaced passage surfaces is such that the liquid films on the relatively moving passage surfaces interact with one another without an intermediate layer between them.

7. A method as claimed in claim 5, and for use in the grinding of a solid powdered material entrained in a carrier liquid, wherein in the subsidiary higher-shear treatment zone the spacing between the closely spaced passage surfaces is the maximum particle size to which the material is to be ground.

8. A method as claimed in claim 1, wherein the mill members are moved so as to produce a linear velocity between the closely spaced passage surfaces relative to one another of between 0.5 and 200 meters per minute.

9. A method as claimed in claim 1, wherein the mill members are respectively a stationary hollow outer cylinder, and a rotatable inner cylinder mounted within the stationary hollow outer cylinder for rotation about a respective longitudinal rotational axis, and wherein the two cylinders are also mounted for movement relative to one another transverse to the rotational axis to thereby vary the spacing between the two opposed flow passage surfaces.

10. A method as claimed in claim 9, wherein the subsidiary higher-shear treatment zone between the mill members is formed between a flat surface portion of the inner surface of the stationary hollow outer cylinder and a convex curved surface portion of rotatable inner cylinder to provide increased convergence of the two surface portions.

11. A method as claimed in claim 1, wherein the mill members are circular plates mounted for rotational movement relative to one another about a common rotational axis passing through their centres, the passage surfaces being constituted by respective opposed surfaces of the two plates, and wherein the plates are also mounted for movement relative to one another along the rotational axis to vary the distance between the two opposed surfaces.

12. A method as claimed in claim 1, wherein the overall high-shear treatment zone and the subsidiary higher-shear treatment zone are coextensive with one another.

13. A method as claimed in claim 1, wherein longitudinal pressure oscillations are applied to a wall of the passage in the overall high-shear treatment zone for enhancement of the treatment action by producing in the material increases in the local viscosity resulting from an elastohydrodynamic squeeze film effect in the liquid films.

14. A method as claimed in claim 1, wherein longitudinal pressure oscillations are applied to a wall of the passage in the overall high-shear treatment zone for enhancement of the treatment action by producing in the material increases in the local viscosity resulting from the production of forced sub-Kolmogoroff eddies therein.

15. Apparatus for high-shear treatment of flowable materials comprising at least two components, one of which is a liquid, the apparatus comprising:

an apparatus frame;

first and second mill members mounted by the apparatus frame and providing respective first and second passage surfaces closely spaced from one another to form a flow passage between them constituting a flow path for the flow therein of the material to be treated, the flow path having a corresponding flow direction, the passage having an inlet thereto and an outlet therefrom;

wherein:

the flow path includes an overall high-shear treatment zone in which the spacing between the passage surfaces allows the coexistence of free supra-Kolmogoroff eddies which are larger than the smallest Kolmogoroff eddy diameter for the flowing material and forced sub-Kolmogoroff eddies which are smaller than the smallest Kolmogoroff eddy diameter;

the overall high-shear treatment zone includes at least a portion thereof in which the passage spacing is smaller than in the remainder of the zone to provide a subsidiary higher-shear treatment zone in which free supra-Kolmogoroff eddies are suppressed during passage of the material therethrough; and motor means are operatively connected to at least one of the mill members to move the member so as to move the first and second passage surfaces relative to one another in a direction transverse to the flow direction at a relative speed in the overall high-shear treatment zone such as to force the simultaneous development of supra-Kolmogoroff and sub-Kolmogoroff eddies for the treatment of the material therein on a supra-micron and sub-micron scale with maintenance of the respective liquid films on the relatively moving passage surfaces so as to thereby render the treated material as uniform as possible;

such relative movement producing in the subsidiary higher-shear treatment zone only forced sub-Kolmogoroff eddies with maintenance of non-turbulent flow.

16. Apparatus as claimed in claim 15, wherein the subsidiary higher-shear treatment zone includes a gap (G) of minimum spacing between the passage surfaces towards which the passage surfaces spacing decreases for the generation of hydrodynamic pressure in the flowing material and resultant local increase in viscosity in the material for enhancement of the treatment action.

17. Apparatus as claimed in claim 16, wherein the overall high-shear treatment zone includes also a gap (H) of maximum spacing between the passage surfaces towards which the passage surfaces spacing increases and the relative movement between the passage surfaces produces cyclic changes in the passage surfaces spacing.

18. Apparatus as claimed in claim 17, and for use in the mixing of the material and/or entrainment of a component in a carrier liquid, wherein in the gap G the spacing between the closely spaced passage surfaces is in the range 1 micrometer–5 mm, and in the gap H the spacing between the closely spaced passage surfaces is in the range 2 mm–2 cm .

19. Apparatus as claimed in claim 15, wherein in the overall high-shear treatment zone the spacing between the closely spaced passage surfaces is in the range 0.1–500 micrometers.

20. Apparatus as claimed in claim 15, wherein the mill members are moved by the motor means so as to produce a linear velocity between the closely spaced passage surfaces relative to one another of between 0.5 and 200 meters per minute.

21. Apparatus as claimed in claim 15, wherein the mill members are respectively a stationary hollow outer cylinder, and a rotatable inner cylinder mounted within the stationary hollow outer cylinder for rotation about a respective longitudinal rotational axis, and wherein the two cylinders are also mounted for movement relative to one another transverse to the rotational axis to thereby vary the spacing between the two opposed flow passage surfaces.

22. Apparatus as claimed in claim 21, wherein the subsidiary higher-shear treatment zone between the mill members is formed between a flat surface portion of the inner surface of the stationary hollow outer cylinder and a convex curved surface portion of rotatable inner cylinder to provide increased convergence of the two surface portions.

23. Apparatus as claimed in claim 15, wherein the mill members are circular plates mounted for rotational movement relative to one another about a common rotational axis passing through their centres, the passage surfaces being constituted by respective opposed surfaces of the two plates, and wherein the plates are also mounted for movement relative to one another along the rotational axis to vary the distance between the two opposed surfaces.

24. Apparatus as claimed in claim 23, wherein the passage surfaces of the mill members are flat and parallel to one another, so that the overall high-shear treatment zone and the subsidiary higher-shear treatment zone are coextensive with one another.

25. Apparatus as claimed in claim 15, wherein at least one longitudinal pressure oscillation producing transducer is connected to a wall of the flow passage in the overall high-shear treatment zone to apply longitudinal pressure oscillations to the material therein for enhancement of the treatment action by producing in the material increases in the local viscosity resulting from an elastohydrodynamic squeeze film effect in the liquid films.

26. Apparatus as claimed in claim 15, wherein at least one longitudinal pressure oscillation producing transducer is connected to a wall of the flow passage in the overall high-shear treatment zone to apply longitudinal pressure oscillations to the material therein for enhancement of the treatment action by producing in the material increases in the local viscosity resulting from the production of forced sub-Kolmogoroff eddies therein.

27. Apparatus as claimed in claim 15, wherein the closely spaced passage surfaces of the mill members have a value M in the range 1–5, where M=F/R, where F is the thickness of the films on the passage surfaces, and where R is the surface roughness.

28. Apparatus as claimed in claim 27, wherein the closely spaced passage surfaces have a dull mirror surface finish or better.

* * * * *